United States Patent [19]

Takefman et al.

[11] 4,094,403

[45] June 13, 1978

[54] DISPLAY CARTON

[76] Inventors: Bram A. Takefman, Evanston; Donald C. Baxter, Winfield, both of Ill.

[21] Appl. No.: 760,028

[22] Filed: Jan. 17, 1977

[51] Int. Cl.[2] ..... B65D 79/00; B65D 5/02

[52] U.S. Cl. ..... 206/45.13; 229/37 R; 229/51 TS

[58] Field of Search ..... 206/45.13, 45.28, 45.29; 229/37 R, 38, 51 TS

[56] References Cited

U.S. PATENT DOCUMENTS

| | | | |
|---|---|---|---|
| 2,168,240 | 8/1939 | Roberts | 206/45.29 |
| 3,159,273 | 12/1964 | Schecterson | 206/45.28 |
| 3,581,977 | 6/1971 | Kirsky | 229/37 R |
| 3,869,078 | 3/1975 | Braun | 229/51 TC |

FOREIGN PATENT DOCUMENTS

| | | | |
|---|---|---|---|
| 43,850 | 6/1934 | France | 229/37 R |

*Primary Examiner*—Herbert F. Ross

[57] ABSTRACT

A combined shipping and merchandising carton for packaged merchandise, which is erected from a die cut blank, and has an end closure provided by flaps that may be folded in one fashion to provide a carton closure, and may be refolded in a different fashion to provide a self-dispensing point of display carton for the packaged merchandise with the merchandise displayed and readily removable at the point of display.

4 Claims, 7 Drawing Figures

DISPLAY CARTON

BACKGROUND OF THE INVENTION

This invention relates to a combined shipping and merchandising carton for shipping packaged merchandise and for converting to a self-dispensing carton for the packaged merchandise after the carton has been opened.

SUMMARY OF THE INVENTION

One object of the invention is to provide a carton structure suitable for dual use, both as a shipping carton for packaged merchandise, and as an attractive point of display self-dispensing carton for the same merchandise.

Another object is to provide such a carton structure with foldable flaps that may be folded in one fashion to provide a carton closure, and may be refolded in a different fashion to provide a self-dispensing point of display carton for the packaged merchandise with the merchandise prominently displayed and readily removable by the customer at the point of display.

Another object is to provide such a carton structure with flaps that may be folded to provide a carton closure, which may be opened without danger of tearing or damaging the same flaps which are refolded to provide a self-dispensing carton for the packaged merchandise.

Another object is to provide a shipping carton convertible to a display carton, the display carton being constructed to hold the packaged merchandise from spilling out of the carton while allowing the individual merchandise packages to be readily extracted by the customer.

Another object is to provide a combined shipping and merchandising carton which is made from a blank die-cut from corrugated paper board or the like carton material with little waste of material, thus providing the advantageous feature of dual use at little or no increased cover over the cost of the usual shipping carton alone.

Another and very practical object is to provide a shipping carton that may be opened and assembled into a self-dispensing display carton by following a straightforward set of instructions requiring no great strength, dexterity or mechanical ability to carry out, and requiring no tools or fasteners (glue, staples, etc.) to complete.

Other objects and advantages of the present invention will become apparent as the following description proceeds, taken in connection with the accompanying drawings.

Figure 1:
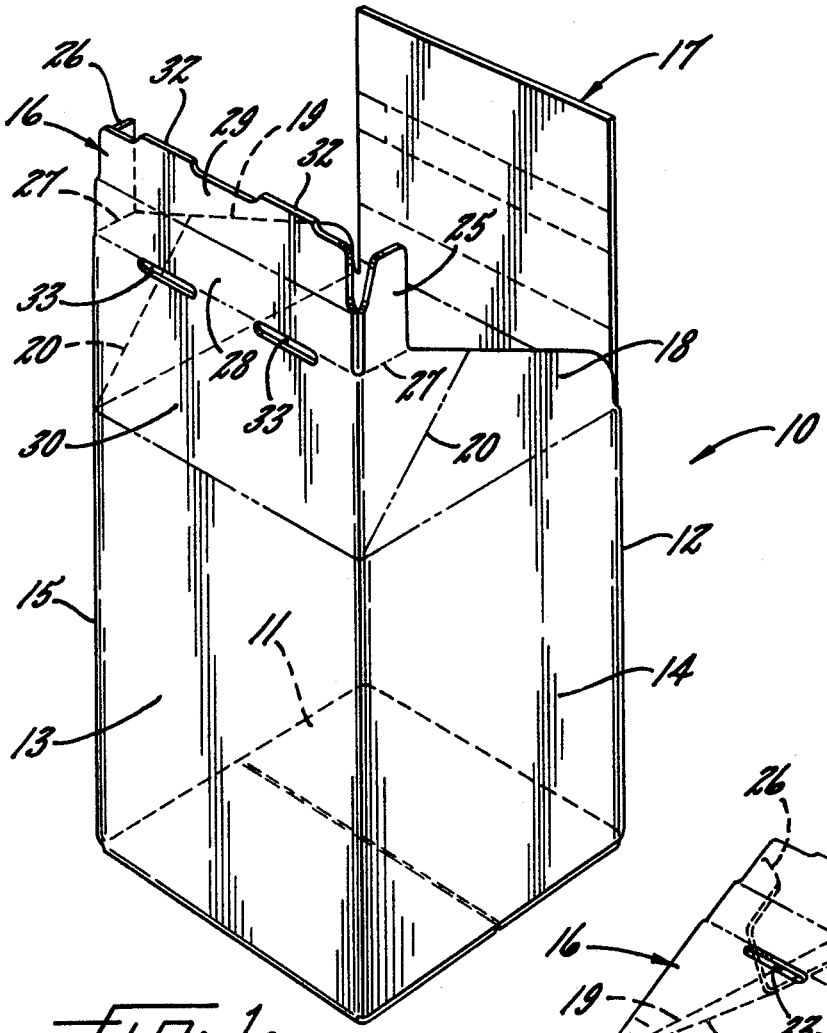
FIG. 1 is a perspective view of an illustrative carton embodying the present invention, with the closure flaps open so that merchandise may be packed into the carton.
Figure 2A:
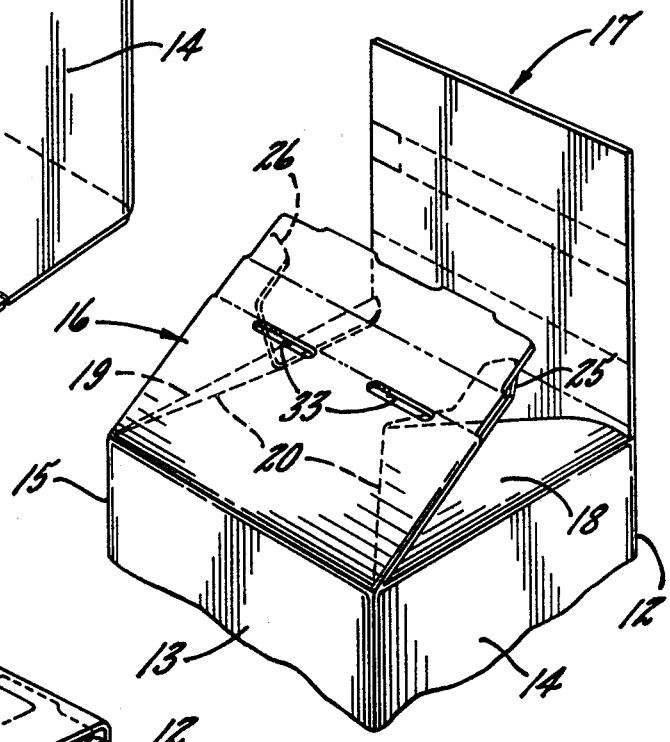
Figure 2B:
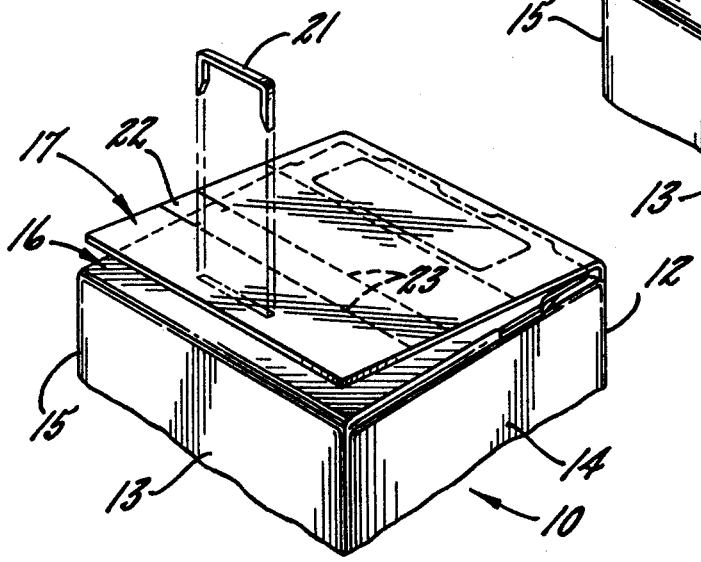
Figure 3A:
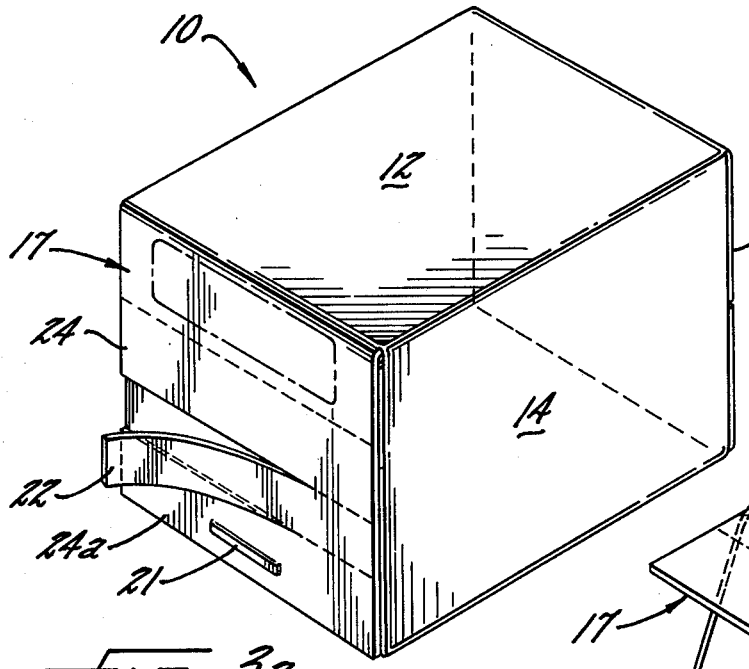
Figure 3B:
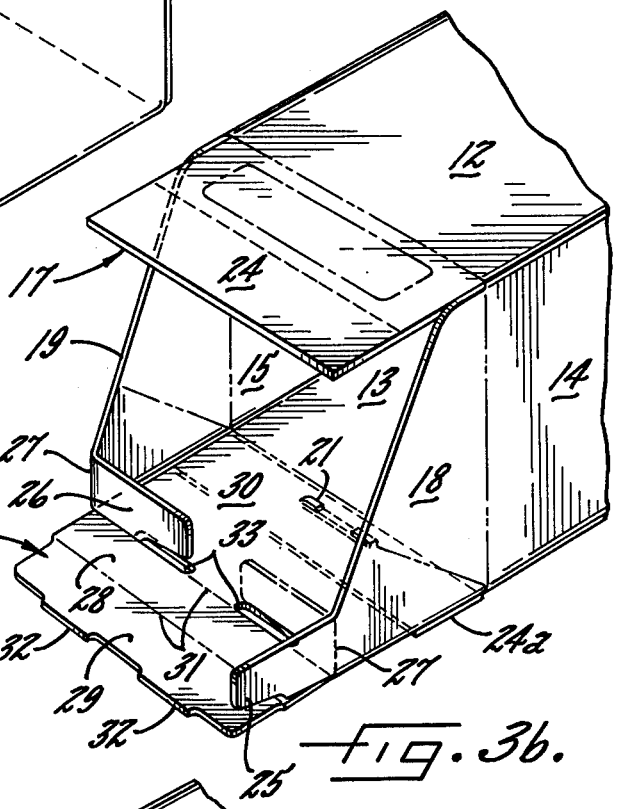
Figure 3C:
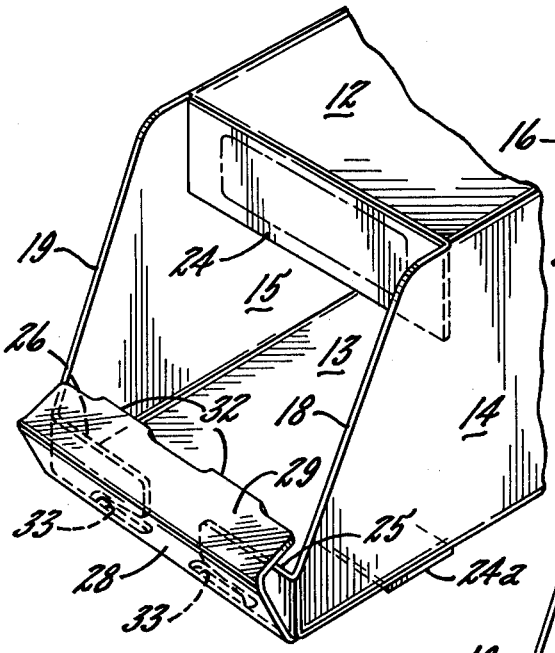
Figure 3D:
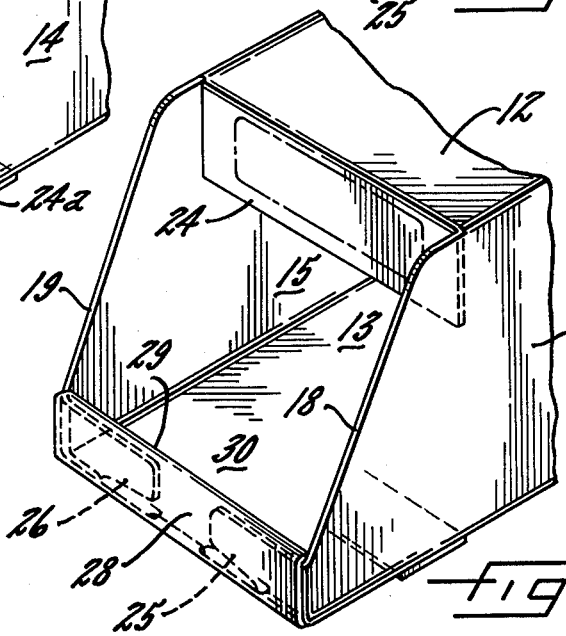

FIGS. *2a* and *2b* are fragmentary perspective views illustrating sequentially various steps in folding the end closure flaps of the carton to closed position;

FIGS. *3a*, *3b* and *3c* are fragmentary perspective views illustrating sequentially various steps in opening the end closure and refolding the flaps to form a self-dispensing display carton; and FIG. *3d* is a fragmentary perspective view of the display carton after the refolding has been completed and showing it in its final assembled form for display of merchandise.

DETAILED DESCRIPTION OF THE PREFERRED EMBODIMENT

While the invention is susceptible of various modifications and alternative constructions, a preferred embodiment of a carton embodying the invention has been shown in the drawings and will be described below in detail. It should be understood, however, that there is no intention to limit the invention to the specific form disclosed. On the contrary, the intention is to cover all modifications, alternative constructions and equivalents falling within the spirit and scope of the invention as expressed in the appended claims.

Referring more specifically to the drawings, there is shown a carton 10 (FIG. 1) which represents a preferred embodiment of the present invention. The carton 10 is formed from corrugated paperboard or other suitable sheet material and comprises a tubular body which is substantially rectangular in cross section. At one end the carton body is provided with a closure 11 of conventional construction, on which the carton is shown resting when standing in an upright position empty and ready for receiving packaged merchandise, which is inserted into the carton through the open opposite end closure which is constructed in accordance with this invention. The carton 10 is shown in its shipping condition in FIG. *3a*, after the end closure of this invention which is shown open in FIG. 1, has been folded to form a sealed end closure. The carton 10 is shown in its self-dispensing display position in FIG. *3d* where it would typically be resting on a counter or shelf with the packaged merchandise visible and prominently displayed through the end closure of this invention after it has been opened and refolded to the display condition shown. Since the orientation of the finally assembled self-dispensing carton is typically horizontal as shown in FIGS. *3b–3d*, when located in that orientation the carton will be seen to have opposing top and bottom panels 12, 13 and opposing side panels 14, 15 joined to the margins of the top and bottom panels 12, 13 to form a body of substantially rectangular cross section. When the carton is stood upright as shown in FIG. 1, it can be seen that the open end closure flaps stand erect allowing packaged merchandise to be packed into the empty carton.

Turning now to the construction of the end closure, in accordance with the invention, an inner flap 16 is provided which is hingedly joined to the end margin of the bottom panel 13 so that it may be folded inwardly, as shown in FIG. *2a*, to form the inner flap of the end closure for the carton. In its closed position, shown in FIG. *2b*, the inner flap 16 is disposed substantially perpendicular to the bottom panel 13. To complete the end closure, an outer flap 17 is provided which is hingedly joined to the end margin of the top panel 12. The outer flap 17 is foldable inwardly over the inner flap 16, as shown in FIG. *2a*, to complete the end closure where it lies substantially perpendicular to the top panel 12 and overlies the inner flap 16 (FIG. *2b*).

In the condition of the carton as shown in FIG. 1, where the end closure is open, the inner flap 16 lies in the same plane as the bottom panel 13 and is foldable inwardly to a position substantially perpendicular to the bottom panel. When the carton is opened and erected to a display self-dispensing position as shown in FIGS. *3b – 3d*, the same inner flap 16 is refolded to return again to a position substantially in the plane of the bottom panel 13.

Both to serve as a portion of a fully secure and sealed end closure, and to contribute to the support of the self-dispensing carton in its assembled position, side flaps 18, 19 are provided between the inner flap 16 and the side panels 14, 15 of the carton. The side flaps are similarly constructed and referencing the side flap 18 in FIG. 1 it will be seen that it is hingedly joined to the end margin of the side panel 14 and also hingedly joined along its bottom margin to the adjacent margin of the inner flap 16. A fold line 20 extends across each of the side flaps 18, 19 thus permitting each side flap to fold upon itself and swing inwardly to a closed position when the inner flap 16 is swung inwardly to its closed position as shown in FIG. *2a*. When in its closed position, each of the side flaps 18, 19 underlies the inner flap 16 and is disposed substantially perpendicular to the respective side panels 14, 15 to which it is joined. These same side flaps 18, 19 in the open upright position of the carton shown in FIG. 1 lie in the plane of the respective side panels 14, 15 to which they are joined, and similarly in the assembled self-dispensing carton position or condition in which these side flaps are shown in FIGS. *3b* – *3d*, they lie in the plane of said side panels 14, 15. After the flaps 16, 17 and side flaps 18, 19 have been folded completely to form the end closure as shown in FIG. *2b*, fastening means herein shown as a staple 21 is used to fasten the multiple layers of material together and secure the end closure. After the staple has been driven home the carton is ready for shipment. While it is preferred to use a staple to secure the flaps forming the end closure, and such has been found satisfactory in practice, other forms of fastening means may be used as desired.

Now turning to FIGS. *3a* – *3d*, it can be seen how the inner and outer flaps 16, 17 together with the side flaps 18, 19 are constructed so as to enable the formation of a self-dispensing carton when the carton is opened and the flaps are refolded. The opening of the end closure is facilitated by the provision of a tear strip 22, the outer flap 17 having been serrated in the formation of the blank to enable the tear strip to be torn free of the flap as shown in FIG. *3a* to open the end closure without prior removal of the staple or fastening means 21. The tear strip 22 is provided by parallel tear lines 23 which extend across at least part of the outer flap 17 and enable the freeing of an upper portion 24 (FIG. *3a*) of the outer flap so that it may be folded outwardly to a position unsecured and separate from the secured lower portion 24*a*. The freeing of the upper portion 24 of the outer flap also enables all of the flaps to be swung outwardly from their closed positions in the process of assembling the carton into its self-dispensing condition.

To enable store personnel to erect or assemble the carton into its self-dispensing display condition, a set of instructions may be printed on an exposed outside panel of the carton such as the bottom panel 13 where the instructions will be concealed after the assembly is completed and the carton has laid flat in its display position. Such set of instructions will enable personnel of normal skill and require no great strength or dexterity to fold the flaps forming the end closure to provide a self-dispensing carton, requiring no staple, glue or other fastening elements to complete the assembly. Thus, as shown in FIGS. *3b* and *3c*, the portion 24 of the outer flap 17 may be swung down from its fully opened position to a merchandising position disposed between the side flaps 18, 19 when the latter are in their open positions, the upper portion 24 of the outer flap then being in a merchandising position disposed between the side flaps and available for placing a label or other advertising material concerning the packaged merchandise in the carton.

In order to secure various flaps of the end closure in the assembled position where they form a self dispensing carton for packaged merchandise, they are provided with means for interengagement with each other, to fasten and lock them together in their final position. Thus as shown in FIGS. *3b* – *3d*, each of the side flaps 18, 19 has a tab 25, 26 projecting from the end of the flap. The tabs extend in the plane of the side flaps 18, 19 when the side flaps are in their open positions as shown in FIG. 1, and are sandwiched between the respective side flaps 18, 19 and the inner flap 16 when the flaps are in their closed positions forming the end closure of the carton. Each tab 25, 26 is joined to its respective side flap along a hinge line 27 which permits each tab to be swung inwardly, as shown in FIG. *3b*, to a merchandising position in the course of assembling the carton into self-dispensing condition, and in the merchandising position each tab 25, 26 is disposed in an upright plane. To secure the tabs 25, 26 in that upright position, the inner flap 16 is provided with a pair of panels 28, 29 (FIG. *3b*) which extend from the main body portion 30 of the inner flap 16 and are joined to it and to each other by parallel fold lines 31. The main body portion 30 of the inner flap extends from the bottom panel 13 to a first fold line 31 which is adjacent the tabs 25, 26 when the latter are in their merchandising positions. The first panel 28 on the inner flap 16 is foldable along the first fold line 31 to swing upwardly to a merchandising position along the outer face of the tabs 25, 26 when the latter are in their merchandising positions, and the second panel 29 is hingedly joined along a fold line to the first panel 28 to wrap down around the upper ends of the tabs 25, 26 to a folded position lying along the inner faces of the tabs. To secure the first and second panels in their folded positions, referring to FIG. *3c*, a pair of ears 32 are provided on the free edge of the second panel 29, and a pair of slots 33 are provided along the first fold line 31 joining the first flap 28 to the body 30 for receiving the ears 32 to lock the tabs 25, 26 and the first and second panels 28, 29 in their merchandising positions as shown in FIG. *3d*.

We claim:

1. A combined shipping and merchandising carton comprising opposite top and bottom panels and two opposing side panels joined to margins of the top and bottom panels to form a carton of generally rectangular cross-section, inner and outer flaps forming an end closure for said carton; said inner flap being hingedly joined to an end margin of said bottom panel to swing outwardly relative to the latter from a closed position in which said inner flap is disposed substantially perpendicular to said bottom panel to an open position in which said inner flap is disposed substantially in the plane of said bottom panel, side flaps hingedly joined to end margins of said side panels and also hingedly joined along their bottom margins to the adjacent margins of said inner flap, a fold line extending across each of said side flaps and permitting each side flap to fold upon itself and swing to a closed position when said inner flap is swung to its closed position and to unfold and swing to an open position when said inner flap is swung to its open position, each of said side flaps, when in its closed position, underlying said inner flap and being disposed substantially perpendicular to its respective side panel and, when in its open position, being disposed substantially in the plane of its respective side panel; a said outer flap being hingedly joined to an end margin of said top panel to swing outwardly relative to the latter from a closed position in which said outer flap is disposed in a plane substantially perpendicular to said top panel and overlies said inner flap, and an open position in which said outer flap is disposed substantially in the plane of said top panel, means for fastening a lower end portion of said outer flap to a lower end portion of said inner flap when said flaps are in said closed positions thereby to hold all of said flaps in said closed positions during shipping, means enabling the freeing of an upper portion of said outer flap from the secured lower portion of said outer flap thereby to permit all of said flaps to be swung open to merchandising positions after shipping; and means for holding said flaps in said merchandising position including tabs projecting from each side flap, each tab being joined to its respective side flap along a hinge line which permits each tab to underly said inner flap when in closed position and to be swung inwardly to a position in which said tab is disposed in an upright plane when said inner flap is in merchandising position, said inner flap being defined by a main body portion extending outwardly from said bottom panel to a location adjacent said tabs when the latter are in said merchandising positions, said inner flap also including a first panel hingedly joined to the outer end of said body portion to swing upwardly to a merchandising position along the outer faces of said tabs when the latter are in their merchandising positions, said inner flap further including a second panel hingedly joined to said first panel to wrap downwardly around the upper ends of said tabs when the latter are in their merchandising positions and to fold to a merchandising position lying along the inner faces of said tabs, an ear on the free edge of said second panel, and a slot in said body portion for receiving said ear to lock said tabs and said first and second panels in their meerchandising positions.

2. A combined shipping and merchandising carton according to claim 1 wherein at least part of the upper portion of said outer flap is swingable inwardly from its open position to an upright merchandising position disposed between said side flaps when the latter are in their open position.

3. A combined shipping and merchandising carton according to claim 2 wherein each said tab is sandwiched between its side flap and said inner flap when said side flaps are in their closed positions and are disposed in the plane of its side flap when such flap is in its open position.

4. A combined shipping and merchandising carton according to claim 1 wherein said means enabling the freeing of said upper portion is a tear portion extending across said outer flap is preformed to facilitate tearing said portion from said outer flap to free an upper portion thereof.

* * * * *